US007971681B2

(12) United States Patent
Bohnaker et al.

(10) Patent No.: US 7,971,681 B2
(45) Date of Patent: Jul. 5, 2011

(54) EXHAUST-GAS MUFFLER

(75) Inventors: Eberhard Bohnaker, Leutenbach (DE); Rebekka Helfen, Stuttgart (DE); Johannes Menzel, Wernau (DE); Helmut Zimmermann, Berglen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 52 days.

(21) Appl. No.: 12/453,917

(22) Filed: May 27, 2009

(65) Prior Publication Data

US 2009/0294210 A1 Dec. 3, 2009

(30) Foreign Application Priority Data

May 31, 2008 (DE) ..... 10 2008 026 333

(51) Int. Cl.

| | |
|---|---|
| ***F01N 1/08*** | (2006.01) |
| ***F01N 1/16*** | (2006.01) |
| ***F01N 5/00*** | (2006.01) |
| ***F01N 13/10*** | (2006.01) |
| ***F01N 13/18*** | (2006.01) |
| ***F16L 15/08*** | (2006.01) |
| ***F16L 17/00*** | (2006.01) |
| ***F16L 17/06*** | (2006.01) |
| ***F16L 19/00*** | (2006.01) |
| ***F16L 27/04*** | (2006.01) |

(52) U.S. Cl. ..... 181/240; 181/212; 181/230; 181/241; 181/277; 277/608; 277/626; 277/627; 285/267; 285/345; 285/368

(58) Field of Classification Search ..... 181/240, 181/212, 230, 241, 277; 264/257, 324; 277/608, 277/626, 627, 936; 285/267, 345, 368, 910
See application file for complete search history.

(56) References Cited

U.S. PATENT DOCUMENTS

| | | | | | |
|---|---|---|---|---|---|
| 2,878,048 | A | * | 3/1959 | Peterson | 277/355 |
| 3,384,200 | A | * | 5/1968 | Baker et al. | 181/230 |
| 4,209,177 | A | * | 6/1980 | Hall | 277/608 |
| 4,551,393 | A | * | 11/1985 | Sumiyoshi et al. | 428/609 |
| 4,715,472 | A | * | 12/1987 | McKee | 181/241 |
| 4,779,904 | A | * | 10/1988 | Rich | 285/345 |
| 4,853,293 | A | * | 8/1989 | Andersson et al. | 428/605 |
| 4,951,954 | A | * | 8/1990 | MacNeill | 277/627 |
| 4,955,218 | A | * | 9/1990 | Brandener | 72/146 |
| 5,040,805 | A | * | 8/1991 | Ozora | 277/627 |
| 5,065,493 | A | * | 11/1991 | Ozora | 29/505 |
| 5,146,434 | A | * | 9/1992 | Bromley | 367/140 |
| 5,451,064 | A | * | 9/1995 | Mercuri et al. | 277/625 |
| 5,499,825 | A | * | 3/1996 | Maeda et al. | 277/626 |
| 5,615,479 | A | * | 4/1997 | Maeda et al. | 29/888.3 |
| 5,712,455 | A | * | 1/1998 | Wagner | 181/238 |
| 5,909,881 | A | * | 6/1999 | Segawa | 277/627 |
| 6,164,410 | A | * | 12/2000 | Linsbauer et al. | 181/230 |
| 6,279,965 | B1 | * | 8/2001 | Kida | 285/268 |
| 6,367,580 | B1 | * | 4/2002 | Chang | 181/241 |
| 6,732,510 | B2 | * | 5/2004 | Ciray | 60/312 |
| 2002/0190483 | A1 | * | 12/2002 | Murakami et al. | 277/627 |

(Continued)

*Primary Examiner* — Jeffrey Donels
*Assistant Examiner* — Christina Russell
(74) *Attorney, Agent, or Firm* — Walter Ottesen

(57) ABSTRACT

An exhaust-gas muffler (1) has a housing (2) through which at least one sleeve (11) projects. At one end, the sleeve (11) has an attachment opening (10) and at the opposite-lying end has an access opening (14). To avoid a contamination of the sleeve (11) during operation, a plug (15, 25, 35, 40, 45, 55) of a pressed metal wire is arranged in the access opening (14).

15 Claims, 4 Drawing Sheets

U.S. PATENT DOCUMENTS

2004/0066007 A1* 4/2004 Kubota et al. ..... 277/608
2004/0108162 A1* 6/2004 Couvrette ..... 181/241
2004/0207162 A1* 10/2004 Kubota et al. ..... 277/650
2005/0198946 A1* 9/2005 Kerchner ..... 60/322
2006/0091616 A1* 5/2006 Kubota et al. ..... 277/627
2007/0246292 A1* 10/2007 Sichau ..... 181/241
2007/0257443 A1* 11/2007 Kubota et al. ..... 277/404

* cited by examiner

EXHAUST-GAS MUFFLER

CROSS REFERENCE TO RELATED APPLICATION

This application claims priority of German patent application no. 10 2008 026 333.8, filed May 31, 2008, the entire content of which is incorporated herein by reference.

FIELD OF THE INVENTION

The invention relates to an exhaust-gas muffler having a housing through which at least one sleeve projects. The sleeve has an attachment opening at one end and, at the opposite-lying end, the sleeve has an access opening.

BACKGROUND OF THE INVENTION

For attaching an exhaust-gas muffler to the cylinder of an internal combustion engine it is known to provide one or several sleeves which project through the entire muffler housing and to arrange attachment elements at the base facing toward the cylinder, for example, attachment screws with which the exhaust-gas muffler can be fastened to the cylinder of the engine. The sleeves make the use of short attachment screws possible.

Dirt can collect in the sleeves during operation of the engine. To avoid this, cover caps of metal are known with which the sleeves can be closed off on the outside of the muffler. These cover caps are usually tightly clamped into the sleeves. These cover caps can loosen because of the high temperatures during operation and because of vibrations and the like. To disassemble the exhaust-gas muffler, the cover caps must first be removed so that the attachment elements are accessible.

SUMMARY OF THE INVENTION

It is an object of the invention to provide an exhaust-gas muffler of the type described above wherein a contamination of the sleeves of the exhaust-gas muffler is avoided in a simple manner.

The exhaust-gas muffler of the invention includes: a housing; at least one sleeve extending through the housing; the sleeve having a first end defining an attachment opening and a second end lying opposite the first end and the second end defining an access opening; a plug made of pressed metal wire; and, the plug being disposed in the access opening.

In lieu of the known covers for closing the sleeves, it is suggested that a plug be provided which is arranged in the access opening. The plug comprises pressed metal wire. The metal wire is placed in irregular loops and is pressed into plug form. In this way, a flexible element having a very large surface is provided.

Advantageously, the plug has a cylindrical section which is braced against the inner wall of the sleeve. The plug is especially pressed into the sleeve. The plug is therefore held in the sleeve because of its inherent elasticity. The metal loops on the outer side of the cylindrical section of the plug touch the inner wall of the sleeve. These touching locations form a point contact or line contact directly after assembly. During operation, vibrations and the high temperatures of the muffler lead, in this region, to the smallest relative movements between the metal loops and the inner wall of the sleeve at each touching location. These relative movements cause microscopically small wear and contact corrosion at the touching locations. Because of the multiplicity of the wear marks and corrosion particles, a tight form and friction connection is achieved between the plug and the sleeve.

In this way, the plug is reliably held in the sleeve in all operating states. Directly after pressing the plug into the sleeve, the plug is held less tight than after a certain operating time because of the wear marks and the corrosion particles. Additional attachment means for the plug can be omitted.

Advantageously, the plug has a conical section at the end thereof projecting into the sleeve whereat the plug tapers. In this way, the insertion of the plug into the sleeve during assembly is facilitated. Because of the conical section, the cylindrical section of the plug is shortened so that, overall, an increased elasticity results. It is practical that a plug have a chamfer at its end facing away from the attachment opening. The chamfer too increases the elasticity of the plug at the end of the plug arranged at the outside of the exhaust-gas muffler. Because of the chamfer, projecting edges of the plug, which result when the plug is not pushed completely into the sleeve, can be avoided.

Advantageously, the plug has a through opening. Because of the through opening, the plug closes the access opening only partially. Here, it is especially provided that the exhaust-gas muffler has an attachment element arranged in the sleeve which extends through the attachment opening and is accessible through the through opening. In this way, the plug need not be disassembled for loosening or fixing the attachment element, for example, for maintenance purposes. The plug can remain in the access opening. The work tool, such as a screw driver or the like, is used to loosen or fix the attachment element. This work tool usually has a significantly lesser outer diameter than the head of the attachment element and the inner diameter of the sleeve. In this way, a through opening in the plug, which is significantly smaller than the head of the attachment element, is sufficient in order to make possible a loosening or fixing of the attachment element after assembly of the attachment element in the sleeve. A contamination of the sleeve is substantially avoided because of the significantly reduced diameter of the through opening.

Advantageously, the plug has a resilient section which at least partially closes the through opening. The resilient section can be pressed away by the work tool to loosen or fix the attachment element so that the attachment element is accessible. After loosening or fixing the attachment element, the work tool is guided out of the sleeve and the plug so that the resilient section can spring back and the through opening can at least again be partially closed. In this way, and in a simple manner, the access opening is closed during operation and a contamination of the sleeve is avoided and, simultaneously, the attachment element is accessible for a work tool. The resilient section is advantageously arranged at the end of the plug projecting into the sleeve. A simple configuration results when the resilient section is formed by individual wire loops. The resilient section can thereby be formed by a special arrangement of the metal wire in the region of the resilient section. The wire loops are advantageously aligned in the resilient section in one direction and are not connected to each other in the peripheral direction. A resilient expansion is made possible because of the inherent elasticity of the wire.

It can also be advantageous that the through opening is closed with a closing stopper. To loosen or fix the attachment element, the closing stopper can be removed so that the attachment element is accessible via the through opening. Because of the reduced temperature in the interior of the plug, the closing stopper does not bake together with the plug so that the accessibility of the through opening is ensured. The closing stopper is advantageously arranged at the end of the plug facing away from the attachment opening. Advantageously, the closing stopper has a cylindrical section which projects into the through opening. In this way, and in a simple manner, a fixing of the closing stopper in the plug is achieved. The closing stopper has an edge whose outer diameter is greater than the inner diameter of the through opening. In this way, it can be ensured that the closing stopper cannot be pushed completely into the plug which would make a disassembly of the closing stopper more difficult. The edge of the closing stopper projects beyond the plug so that the closing stopper can be pulled at the edge from the plug.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
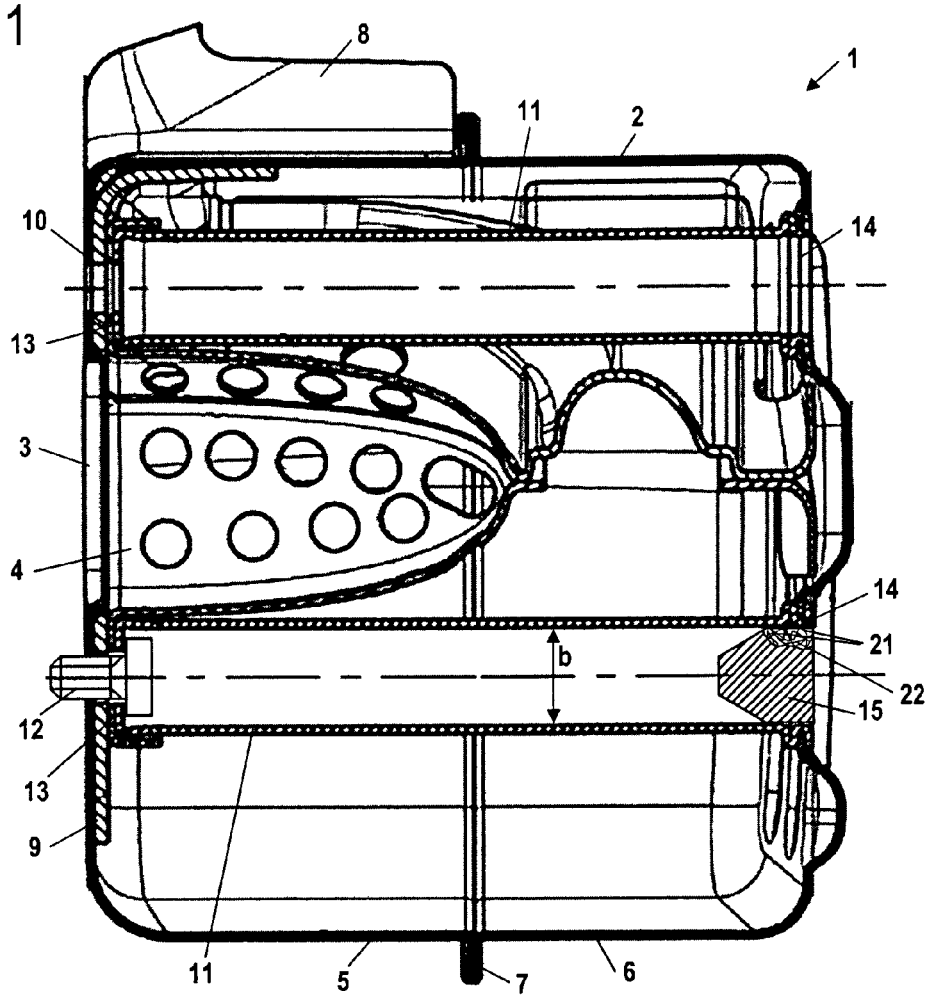
FIG. 1 is a section view taken through an exhaust-gas muffler according to the invention.

The exhaust-gas muffler 1 shown in FIG. 1 can, for example, be an exhaust-gas muffler in a portable handheld work apparatus such as a motor-driven chain saw, cutoff machine, brushcutter or the like. The exhaust-gas muffler 1 has a housing 2 into which an inlet 3 leads. The inlet 3 is connected to the outlet from an internal combustion engine, for example, a two-stroke engine or a mixture-lubricated four-stroke engine. In the interior of the housing 2, an exhaust-gas spray nozzle 4 is arranged next to the inlet 3 and this spray nozzle leads to a good attenuation of noise. The housing 2 is made up of a first half shell 5 and a second half shell 6 which are connected gas tight to each other at an edge 7. The first half shell 5 has the inlet 3 and is advantageously arranged facing toward an internal combustion engine. An outlet (not shown) leads from the housing 2 and is covered by an outlet cover or hood 8. A stiffening sheet metal member 9 is arranged in the interior of the first half shell 5 and is arranged on the side facing toward the internal combustion engine and has an opening for the inlet 3 into the housing 2.

Attachment screws 12 are provided for fixing the exhaust-gas muffler 1 on the outlet of an internal combustion engine and one of the attachment screws 12 is shown in FIG. 1. The attachment screws 12 are arranged next to the inlet 3 and extend through attachment openings 10 of the exhaust-gas muffler 1. The attachment openings 10 are configured as passthrough openings through the first half shell 5, the reinforcement sheet metal piece member 9 as well as the base 13 of the sleeves 11. In the embodiment, two sleeves 11 are provided which pass through the housing 2 of the exhaust-gas muffler 1 and extend from the side of the housing 2, which lies opposite to the inlet 3, up to next to the reinforcement sheet metal member 9. The sleeves 11 are configured closed to the interior space of the housing 2. The head of the attachment screw 12 can lie on the base 13 of the sleeve 11 and so fix the exhaust-gas muffler 1 to a cylinder of an internal combustion engine.

To assemble the attachment screws 12 in the sleeves 11, the sleeves 11 each have an access opening 14 on the side lying opposite the base 13. The access opening 14 connects the interior of the sleeve 11 to the ambient. The attachment screws 12 can be arranged in the attachment openings 10 via the access openings 14. A tool can be introduced and led to the attachment screws 12 via the access openings 14 and, with this tool, the attachment screws 12 can be fixed or released.

Figure 20:
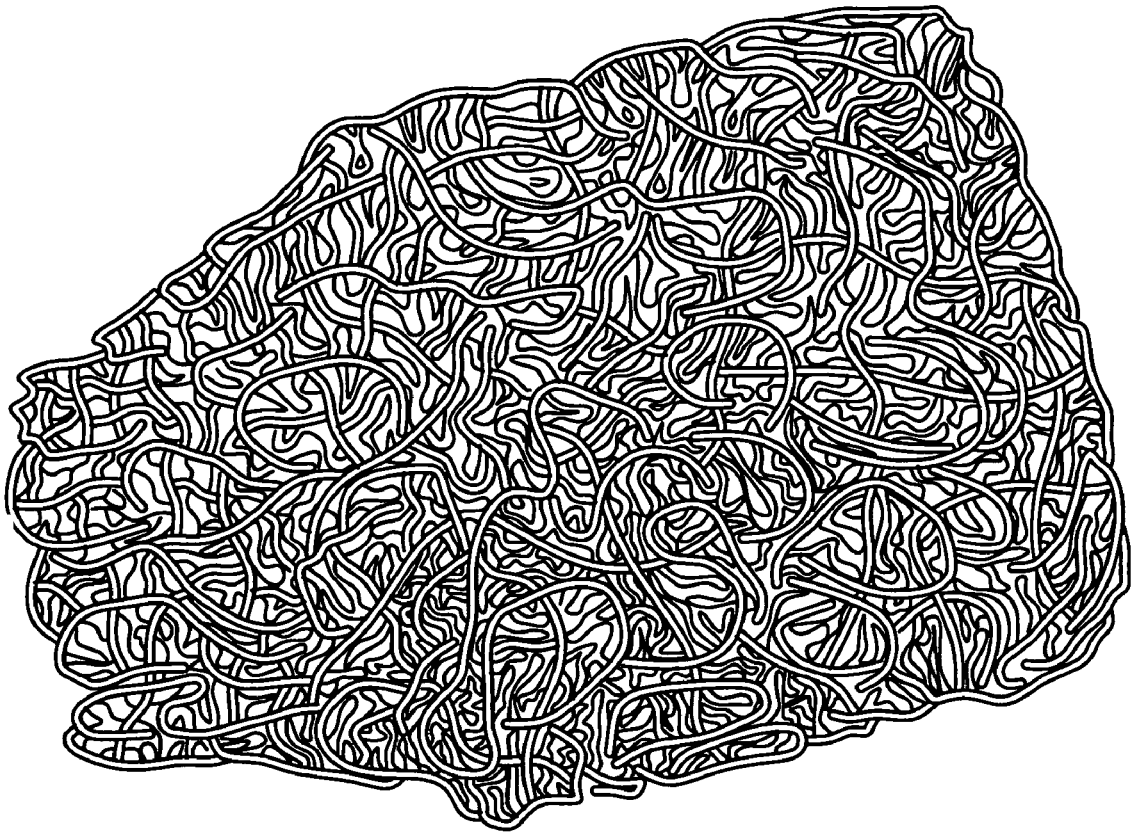
FIG. 20 is a perspective view of the plug shown in FIGS. 1 to 4.

A plug 15 is arranged in the sleeve 11 in the region of the access opening 14 to prevent a contamination of the interior of the sleeve 11. This is shown by way of example in FIG. 1 for one of the two sleeves 11. The plug 15 comprises a metal wire 22 which is arranged in non-uniform loops 21 and is pressed into the shape of a plug shown in FIG. 1. The plug is permeable to air so that the sleeve 11 is not closed off seal tight to the ambient. FIG. 20 is a perspective enlarged view of plug 15 clearly showing the non-uniform loops making up the plug. The wire is made of high-grade steel and has a diameter of 0.23 mm; however, the high-grade steel can have a diameter lying in the range of 0.1 mm to 1 mm.

Figure 19:
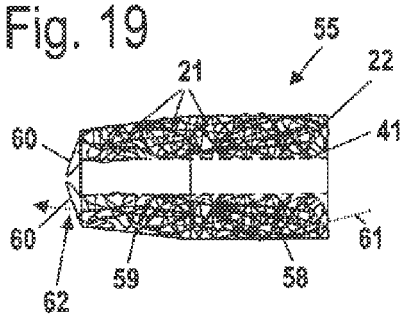
FIG. 19 is a side elevation view of still another plug.

In FIG. 19, the build-up with metal wire loops 21 is shown by way of example for a plug 55. The other plugs shown are built up in a corresponding manner and, to simplify the illustration in the drawings, the plug is, however, shown by hatching. As shown in FIG. 19, air can pass between the individual metal wire loops 21 because of the intermediate spaces shown between the loops 21. The flow of air is indicated by arrow 61.

Figure 2:
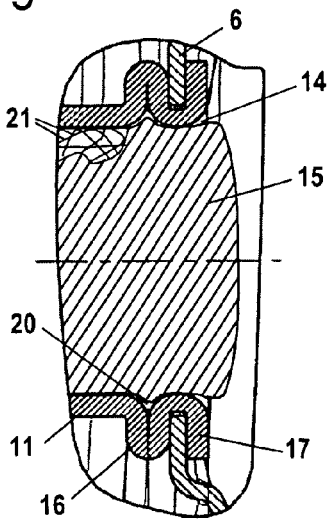
FIG. 2 shows an enlarged detail section view of the sleeve of the exhaust-gas muffler of FIG. 1 in the region of the access opening.

The metal wire 22 has a high thermal stability. Because of the local contacts of the plug with the sleeve 11 at individual metal wire loops 21 as shown in FIGS. 1 and 2, the plug 15 is fixed in the sleeve 11 at the high temperatures during operation and because of wear via wear marks and corrosion particles so that the plug 15 is held tightly in the sleeve 11. The wear is generated by vibrations. The plug 15 is advantageously pressed into the sleeve 11 and is first held in the sleeve 11 by its inherent elasticity.

In order to ensure a reliable seating of the plug 15 in the sleeve 11, the outer diameter (a) of the plug 15 (see FIG. 4) corresponds at least to the inner diameter (b) of the sleeve 11 shown in FIG. 1. Advantageously, the outer diameter (a) is somewhat greater than the inner diameter (b) so that the plug 15 is braced in the sleeve 11.

Figure 3:
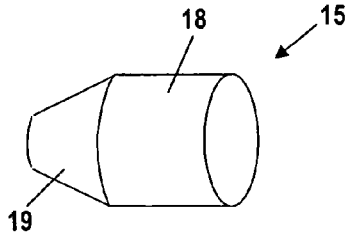
FIG. 3 is a perspective view of a plug.
Figure 4:
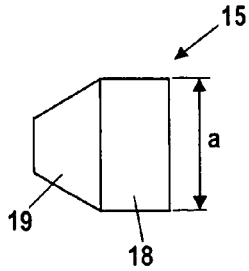
FIG. 4 is a side elevation view of the plug of FIG. 3.

As FIGS. 3 and 4 show, the plug 15 has a cylindrical section 18 which extends into a conical section 19. The conical section 19 projects into the sleeve 11 in the direction toward the base 13. At the conical section 19, the outer diameter (a)

tapers to a lesser diameter. The conical section 19 is configured to be flat at its end projecting into the interior of the sleeve 11.

As FIG. 2 shows, the sleeve 11 has an outwardly projecting fold 16 in the region of the access opening 14 whereat the second half shell 6 lies in contact engagement. The sleeve 11 is bent over outwardly to edge 17 outside of the second half shell 6 so that the second half shell 6 is held between the fold 16 and the edge 17. In this way, a gas-tight connection is provided between the sleeve 11 and the second half shell 6. A recess 20 is formed in the sleeve 11 in the region of the fold 16 and the plug 15 is pressed partially into this recess 20. In this way, a form-tight fixation of the plug 15 in the sleeve 11 is obtained. To loosen the attachment screw 12, the plug 15 must be removed from the sleeve 11 or a corresponding opening must be introduced into the plug 15.

Figure 5:
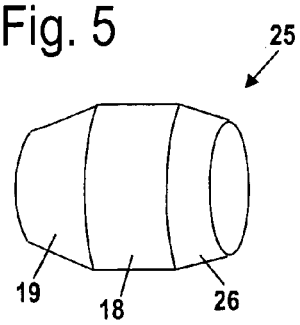
FIG. 5 is a perspective view of another embodiment of a plug.
Figure 6:
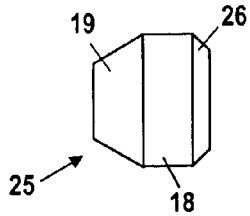
FIG. 6 is a side elevation view of the plug of FIG. 5.

FIGS. 5 and 6 show an embodiment of a plug 25 whose configuration corresponds essentially to that of plug 15. In addition to the cylindrical section 18 and the conical section 19, the plug 25 has a chamfer 26 on the side facing away from the conical section 19 and projecting on the outer side of the exhaust-gas muffler 1.

Figure 7:
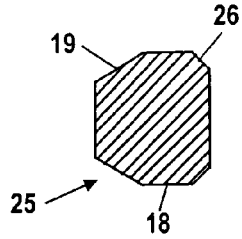
FIG. 7 is a section view of the plug of FIG. 5.
Figure 8:
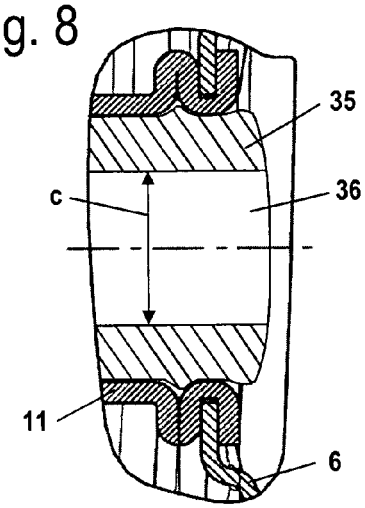
FIG. 8 is an enlarged section view of the sleeve in the region of the access opening with a further embodiment of a plug.
Figure 9:
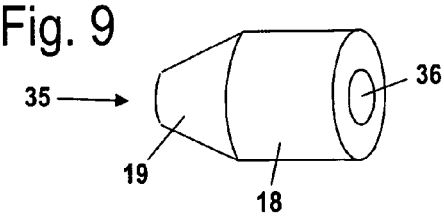
FIG. 9 is a perspective view of the plug of FIG. 8.
Figure 10:
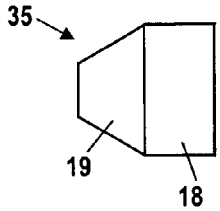
FIG. 10 is a side elevation view of the plug of FIG. 8.
Figure 11:
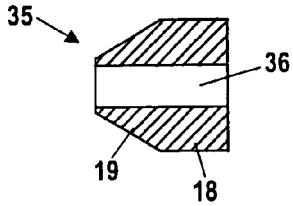
FIG. 11 is a section view of the plug of FIG. 8.

FIGS. 8 to 11 show an embodiment of a plug 35. The plug 35 likewise has a cylindrical section 18 from which a conical section 19 extends. In addition, the chamfer 26, which is shown in FIGS. 5 to 7, can be provided. As FIGS. 8 to 11 show, the plug 35 has a through opening 36 whose inner diameter (c) is less than the inner diameter (b) of the sleeve 11 and the outer diameter (a) of the cylindrical section 18. The inner diameter (c) advantageously corresponds to the outer diameter of a work tool which is needed to tighten or loosen the attachment screw 12. The attachment screw 12 is accessible for a work tool through the through opening 36 so that the plug 35 can remain in the access opening 14 when the exhaust-gas muffler 1 is, for example, loosened from the cylinder or is tightened thereon. The inner diameter (c) is advantageously less than the head of an attachment screw 12 so that the attachment screw 12 is held in the sleeve 11 so as not to separate therefrom.

Figure 12:
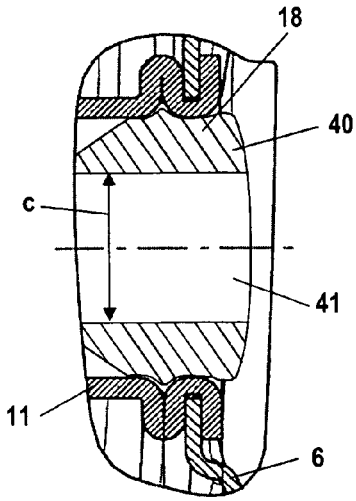
FIG. 12 shows an enlarged section view of a sleeve in the region of the access opening having a plug according to a further embodiment of the invention.
Figure 14:
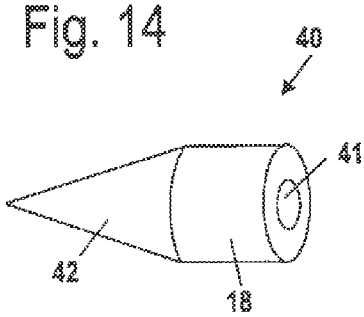
FIG. 14 is a perspective view of the plug of FIG. 12.
Figure 15:
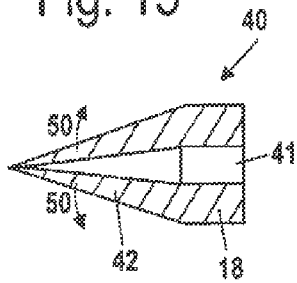
FIG. 15 is a section view of the plug of FIG. 12.

FIG. 12 shows an embodiment of a plug 40 which has a through opening 41. The through opening 41 has an inner diameter (c). The plug 40 differs from the plug 35 by a shortened cylindrical section 18. As FIGS. 14 and 15 show, a spring section 42 extends from the cylindrical section 18 whereat the plug 40 tapers to a point in the embodiment. The spring section 42 is so configured that a widening in the direction of the arrows 50 is possible when, for example, a work tool is pushed through the through opening 41. In the position shown in FIG. 15, the spring section 42 substantially closes the through opening 41. In this way, the sleeve 11 is closed during operation so that the sleeve 11 cannot become contaminated. For maintenance purposes, a work tool can be pushed through the through opening 41 which widens the spring section 42 and so makes possible access to the interior of the sleeve 11 and to the attachment screw 12. After removing the work tool, the spring sections 42 again move toward each other so that the through opening 41 is essentially closed by the spring sections 42.

Figure 13:
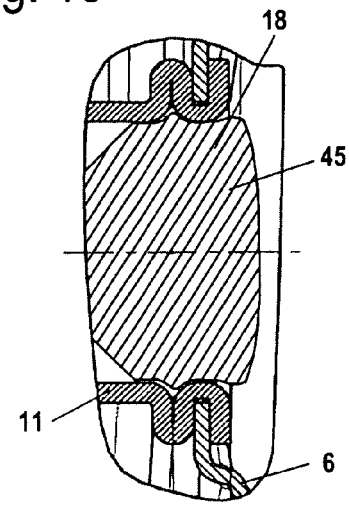
FIG. 13 is an enlarged section view of the sleeve in the region of the access opening with still another embodiment of the plug.
Figure 16:
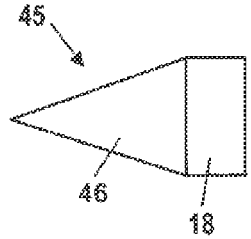
FIG. 16 is a side elevation view of the plug of FIG. 13.

FIG. 13 shows an embodiment of a plug 45 which likewise has a shortened cylindrical section 18. The plug 45, however, has no through opening. As shown in FIG. 16, the plug 45 has a conical section 46 whereat the plug 45 tapers to a tip.

Figure 17:
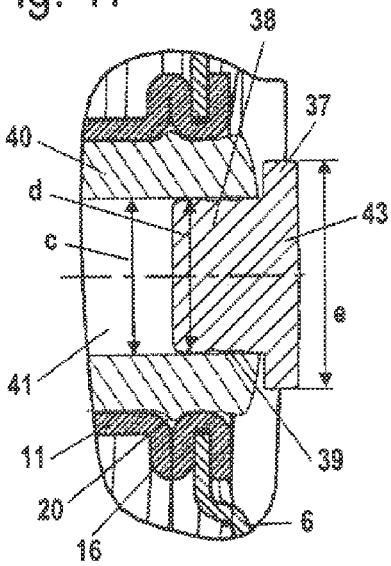
FIG. 17 is a section view of a sleeve in the region of the access opening with a plug arranged thereat.

As shown in FIG. 17, a closing stopper 43 can be additionally arranged in the plug 40 and this closing stopper projects from the outer side into the through opening 41. The closing stopper 43 has a cylindrical section 38 which is arranged in the through opening 41 as well as an edge 37. The edge 37 has an outer diameter (e) which is significantly greater than the inner diameter (c) of the through opening 41. In this way, it is ensured that the edge 37 lies against the end face of the plug 40. At the edge 37, the closing stopper 43 can easily be removed from the through opening 41 when access is needed to the attachment screw 12.

As shown in FIG. 17, the cylindrical section 38 has an outer diameter (d) which corresponds approximately to the inner diameter (c) of the through opening 41. Advantageously, the outer diameter (d) is slightly greater than the inner diameter (c) when the closing stopper 43 is not mounted in the through opening 41 so that the closing stopper 43 is pressed into the through opening 41. A profile 39 is provided at the outer end of the cylindrical section 38. The profile 39 leads to a better fixation of the closing stopper 43 in the through opening 41. The closing stopper 43 can likewise comprise a pressed metal wire; however, other materials can also advantageously be used for the closing stopper 43. For example, the closing stopper 43 can consist of solid material such as metal.

Figure 18:
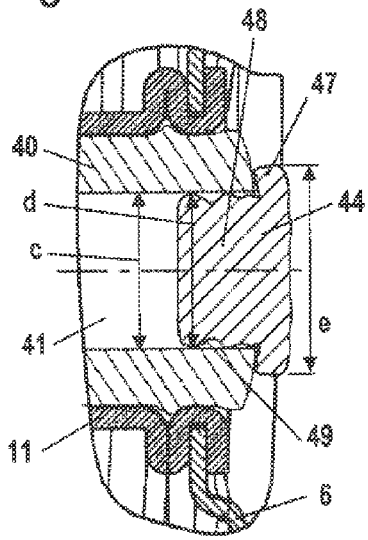
FIG. 18 is a section view of a sleeve in the region of the access opening with a sealing plug arranged thereat.

In FIG. 18, an embodiment of a closing stopper 44 is shown which can be arranged in the through opening 41. The closing stopper 44 has an edge 47 which likewise has an outer diameter (e) which is significantly greater than the inner diameter (c) of the through opening 41. The edge 47 of the closing stopper 44 is configured to be slightly arcuate so that the edge 47 lies against the end face of the plug 40. The closing stopper 44 has a cylindrical section 48 which projects into the through opening 41 and has a profile 49 which is configured to be greater than the profile 39 of the closing stopper 43. The cylindrical section 48 likewise has an outer diameter (d) which is advantageously slightly greater than the inner diameter (c) of the through opening 41 in the non-assembled state of the closing stopper 44. Closing stoppers (43, 44) can be advantageous for plug 40 having a spring section 42 as well as for plug 35 wherein the through opening 36 is configured to be open.

FIG. 19 shows an embodiment of a plug 55 which has a cylindrical section 58 and a conical section 59. A spring section 62 extends from the conical section 59 and this section 62 is configured by individual wire loops 60. The wire loops 60 are pretensioned radially inwardly in the direction toward the through opening 41. The wire loops 60 are each connected at their ends to the conical section 59 so that the wire loops 60 are not connected directly to each other in the peripheral direction. In this way, an expansion of the spring section 62 is made possible in a simple manner. The spring section 42 of the plug 40 can be correspondingly configured. The entire plug is built up of metal wire 22 which is placed or laid in loops 21 and which define the wire loops 60. The arrow 61 shown with a broken line indicates the air permeability of the plug 55.

It is understood that the foregoing description is that of the preferred embodiments of the invention and that various changes and modifications may be made thereto without departing from the spirit and scope of the invention as defined in the appended claims.

What is claimed is:

1. An exhaust-gas muffler comprising:

a housing;

at least one sleeve extending through said housing;

said sleeve having a first end defining an attachment opening;

a fastening element projecting through said attachment opening for fixing said exhaust-gas muffler;

said sleeve having a second end lying opposite said first end and said second end defining an access opening;

a plug made of pressed metal wire; and, said plug being disposed in said access opening and being permeable to air so as to prevent said sleeve from being sealed off with respect to the ambient.

2. The exhaust-gas muffler of claim 1, wherein said sleeve has an inner wall surface; and, said plug has a cylindrical section braced against said inner wall surface.

3. The exhaust-gas muffler of claim 2, wherein said plug is pressed into said sleeve.

4. The exhaust-gas muffler of claim 3, wherein said plug has an end portion projecting into said sleeve; and, said plug has a conical section at said end portion whereat said plug is tapered.

5. The exhaust-gas muffler of claim 1, wherein said plug has an end facing away from said attachment opening; and, said plug has a chamfer formed on said end.

6. The exhaust-gas muffler of claim 1, wherein said plug has a passthrough opening formed therein.

7. The exhaust-gas muffler of claim 6, wherein said fastening element is disposed in said sleeve; and, said fastening element is accessible through said passthrough opening.

8. The exhaust-gas muffler of claim 6, wherein said plug has a resilient section which at least partially closes said passthrough opening.

9. The exhaust-gas muffler of claim 8, wherein said plug has an end projecting into said sleeve and said resilient section is disposed at said end of said plug.

10. The exhaust-gas muffler of claim 8, wherein said resilient section is formed by individual wire loops.

11. The exhaust-gas muffler of claim 6, further comprising a closure stopper for closing said passthrough opening.

12. The exhaust-gas muffler of claim 11, wherein said plug has an end facing away from said attachment opening; and, said closure stopper is arranged at said end of said plug.

13. The exhaust-gas muffler of claim 11, wherein said closure stopper has a cylindrical section projecting into said passthrough opening.

14. The exhaust-gas muffler of claim 13, wherein said closure stopper has a rim having an outer diameter (e) greater than the inner diameter (c) of said passthrough opening.

15. The exhaust-gas muffler of claim 1, wherein said housing defines an interior space; and, said sleeve is configured so as to be closed-off with respect to said interior space.

* * * * *